US007198164B2

(12) United States Patent
Yourist et al.

(10) Patent No.: US 7,198,164 B2
(45) Date of Patent: Apr. 3, 2007

(54) HOT-FILLABLE CONTAINER WITH A WAISTED DOME

(75) Inventors: Sheldon Yourist, York, PA (US); Angie Noll, York, PA (US); Richard K. Ogg, Littlestown, PA (US)

(73) Assignee: Graham Packaging Company, L.P., York, PA (US)

( * ) Notice: Subject to any disclaimer, the term of this patent is extended or adjusted under 35 U.S.C. 154(b) by 0 days.

(21) Appl. No.: 10/813,301

(22) Filed: Mar. 31, 2004

(65) Prior Publication Data

US 2004/0200799 A1 Oct. 14, 2004

Related U.S. Application Data

(60) Provisional application No. 60/458,891, filed on Mar. 31, 2003.

(51) Int. Cl.
*B65D 1/02* (2006.01)
*B65D 1/42* (2006.01)

(52) U.S. Cl. ..... 215/381; 215/384; 215/398; 220/669; 220/675; 220/771

(58) Field of Classification Search ..... 215/381, 215/383, 384, 900, 379, 382, 396; 220/671, 220/675, 771, 666.669
See application file for complete search history.

(56) References Cited

U.S. PATENT DOCUMENTS 5,303,834 A 4/1994 Krishnakumar et al.
5,392,937 A * 2/1995 Prevot et al. ..... 215/400
5,407,086 A * 4/1995 Ota et al. ..... 215/383
D366,831 S * 2/1996 Semersky et al. ..... D9/434
5,704,503 A * 1/1998 Krishnakumar et al. .... 215/381
5,758,790 A * 6/1998 Ewing, Jr. ..... 215/384
5,762,221 A 6/1998 Tobias et al.
5,908,128 A * 6/1999 Krishnakumar et al. .... 215/381
D413,519 S * 9/1999 Eberle et al. ..... D9/538
D415,681 S * 10/1999 Yourist ..... D9/434
6,257,433 B1 * 7/2001 Ogg et al. ..... 215/381
D446,126 S * 8/2001 Bretz et al. ..... D9/538
6,585,125 B1 * 7/2003 Peek ..... 215/381

* cited by examiner

*Primary Examiner*—Sue A. Weaver
(74) *Attorney, Agent, or Firm*—Venable; James R. Burdett; Keith G. Haddaway

(57) ABSTRACT

A hot-fillable blow molded plastic container having a finish with an opening; a base; a lower bumper transition; an upper bumper transition and a tubular dome. The upper bumper transition and lower bumper transition defines a label mounting region. The label mounting region includes a circumferential ring adjacent to the upper bumper transition a vacuum panel. The tubular dome can be between the upper bumper transition and the finish and can has a cross sectional shape that is substantially the same throughout. The tubular dome includes an upper bell and a lower bell separated by a peripheral waist that has a diameter less than that of the upper and lower bell.

27 Claims, 9 Drawing Sheets

HOT-FILLABLE CONTAINER WITH A WAISTED DOME

BACKGROUND OF THE INVENTION

1. Field of the Invention

The present invention relates generally to a container suitable for use in a hot-fill process, and more particularly to a container with a dome having a waist and no reinforcing ribs and the container having a circumferential ring that can be located under a label.

2. Related Art

Blow-molded plastic containers have become commonplace in packaging beverages and other liquid, gel, or granular products. While a container may provide an appealing appearance when it is initially removed from blow-molding machinery, many forces act subsequently on, and alter, the shape from the time it is blow-molded to the time it is placed on a shelf in a store. Plastic containers are particularly susceptible to distortion after hot-filling and capping when design changes are implemented to reduce the amount of plastic required to make the container. While there is a savings with respect to material cost, the reduction of plastic can decrease container rigidity and structural integrity.

In the packaging of beverages, for example juices, blow-molded plastic polyethylene terephthalate (PET) containers are commonly used in hot-fill processes. In the hot-fill process, a container is filled with a product at an elevated temperature, sealed and allowed to cool. Several internal forces act on the container during hot-fill processing. For example, when the heated product is added, softening of the plastic can occur that can tend to cause distortion. As the container and the contained product cools, a partial vacuum is created inside the container, placing forces on the container that can cause it to partially collapse. Hot-fillable plastic containers must provide sufficient flexure to compensate for the changes of pressure and temperature, while maintaining structural integrity and aesthetic appearance. The flexure is most commonly addressed with vacuum flex panels positioned under a label below the dome.

In addition to internal forces, external forces are applied to sealed containers as they are packed and shipped. Filled containers are packed in bulk in cardboard boxes, or plastic wrap, or both. A bottom row of packed, filled containers may support several upper tiers of filled containers, and potentially, several upper boxes of filled containers. Therefore, it is important that the container have a top loading capability which is sufficient to prevent distortion from the intended container shape.

Dome region ovalization is a common distortion associated with hot-fillable, blow-molded plastic containers. The dome is the upper portion of the container adjacent the finish. Some dome configurations are designed to have a horizontal cross-section which is circular in shape. The forces resulting from hot-filling and top loading can change the intended horizontal cross-sectional shape, for example, from circular to oval.

FIG. 1 illustrates a blow-molded plastic container 100 according to the prior art that has features common to other known containers. For instance, the container 100 has a finish 102 which provides an opening 104 for filling and subsequent emptying of the container contents, as well as for receiving a closure (not shown). A dome 106 extends from the finish 102 to a circumferential ring 108. The circumferential ring 108 is preferably located in the shoulder of the container just below the dome 106. The circumferential ring

108 has a concave structure, the concavity being an arc with a relatively small radius. It is also preferred that the arc sweep out a significant angle. The curvature of the concavity together with its extent and depth allow the circumferential ring 108 to provide structural support to prevent shape distortion of the container, particularly in preventing ovalization of the container sidewalls and/or dome 106. Particular dimensional properties of the arc that defines the circumferential ring providing the necessary rigidity are known in the art and given in, for example, U.S. Pat. No. 5,303,834, which is incorporated herein by reference in its entirety.

An upper label bumper 110 is located below the circumferential ring 108. The container 100 has a base 112 which is located remote from the finish 102 and which extends to a lower label bumper 114. The lower label bumper 114 and upper label bumper 110 define the extent of a label mounting area 116. The label mounting area 116 has a series of spaced-apart vacuum flex panels 118 which accommodate volumetric changes to a hot-filled container after it has been sealed and as it cools.

The dome 106 of the container illustrated in FIG. 1 has a bell-shaped profile and a substantially circular horizontal cross-section. In this example, the horizontal cross-section through the dome 106, starting from beneath the finish 102, increases in diameter in an upper dome portion as it extends toward the base 112, decreasing to form the circumferential ring 108. Below the circumferential ring 108, the container diameter increases to the upper label bumper 110.

Although the circumferential ring 108 resists ovalization and assists in maintaining the structural integrity of the container, as efforts are made to lightweight plastic containers, vacuum forces will act on thin regions susceptible to distortion causing disfiguration of the container. One region that is particularly susceptible to such forces is the dome. The dome represents a relatively large open area that may have little in the way of support structure. To provide support for the dome under vacuum forces, structural features can be added to the dome to provide reinforcement. For example, U.S. Pat. No. 5,762,221 of common assignee, which is incorporated herein by reference in its entirety, describes the use of reinforcing ribs 125 to provide structural support to the dome 106. The reinforcing ribs, which may either extend into or out from the container, interrupt the generally circular cross section. Such a design allows for an adequately large logo presentation area 120 when the container is of sufficient size, for example a container designed to hold about 32 ounces of a fluid product. However, as the container size decreases, for example to hold about 20 fluid ounces or less, the logo presentation area 120 also decreases in size as the reinforcement ribs 125 become closer together. This reduction in size of the logo presentation area can be undesirable to the commercial manufacturers of products packaged in the containers.

FIG. 2 illustrates another prior art approach that provides a container 200 having a dome 206 with top load strength and resistance to ovalization. The dome 206 of this design does not have any ribs, but is substantially conical in shape. The conical shape provides sufficient top load strength and resistance to ovalization to be commercially viable. However, even in this configuration, the size of the logo presentation area 220 is reduced due to the tapering of the dome 206, and can be less than what is commercially desirable.

While features such as a circumferential ring and reinforcing ribs provide structural support to the dome, use of these features imposes restrictions on the design of containers. These restrictions limit the ability to incorporate features that may be important commercially to manufacturers of products packaged in the containers. For example, the use of reinforcing ribs 125 limits the open areas of the dome that may the used for a logo presentation area. These open areas can be sufficiently large to hold a product logo in containers designed to contain relatively large amounts, for example 32 ounces, of liquid; however, as the size of the container is reduced, the logo presentation area necessarily decreases in size to accommodate space for the ribs 125. Moreover, because the circumferential ring is used as a reinforcing structure for the dome, it must generally be located relatively close to the dome and is typically adjacent to the dome. Due to the proximity of the circumferential ring to the dome, it is most often located above the upper bumper and outside of the label mounting area so that it is visible in the final packaged product. Additionally, the circumferential ring must have a concavity that is sufficiently arcuate to provide structural support to the dome. These features, i.e. reinforcing ribs and/or a circumferential ring, which are required to maintain structural integrity of prior art hot-fill containers, reduce the ability to design containers that do not contain a visible waist or reinforcing ribs outside the label mounting area or that have a sufficiently large uninterrupted dome for placement of a logo.

Although containers having a specific dome configuration may function satisfactorily for their intended purposes, there is continuing need for blow-molded plastic containers having a dome which controls the amount of ovalization distortion due to hot-filling, and resists compressive distortions due to top loading. Such a container is desirably made from a minimal amount of plastic to afford efficient manufacture. Incorporating an aesthetically pleasing appearance while being able to maintain structural integrity of the container during the hot-fill process remains a challenge.

BRIEF SUMMARY OF THE INVENTION

In summary, the invention is directed toward a hot-fillable blow molded plastic container having a finish with an opening; a base; a lower bumper transition; an upper bumper transition and a tubular dome. The upper bumper transition and lower bumper transition defines a label mounting region. The label mounting region includes a circumferential ring adjacent to the upper bumper transition a vacuum panel. The tubular dome can be between the upper bumper transition and the finish and has a cross sectional shape that is substantially the same throughout. The tubular dome includes an upper bell and a lower bell separated by a peripheral waist that has a diameter less than that of the upper and lower bell.

This invention eliminates the need for a circumferential ring adjacent to the container dome. Rather, according to the present invention, the circumferential ring can be located in the label region so that it is covered by the label. This configuration allows for broad ranges in design while hiding the circumferential ring.

This invention differs from the prior art in modifications which were not previously known or suggested. Such modifications include use of a dome having a large upper bell that provides a large logo presentation area as compared to prior art domes having structural ribs and/or a conical shape. Domes with an expanded upper bell have not been achieved in the absence of additional structural support, such as structural ribs, without sacrificing top load strength or making the container susceptible to ovalization.

The dome on containers according to the invention can have a cross section that is substantially circular, substantially oval, substantially triangular, substantially rectangular, substantially square or substantially polyhedral. The dome has a large logo presentation area that can include an embossed logo. Further, the upper bell, waist and lower bell cooperate to provide increased top load performance and resistance to ovalization.

The label mounting region of the container can include a label, under which is located a vacuum flex panel. The label mounting region can have a width that is less than the width of the base and the lower bell. The base and the lower bell can have substantially the same width. The upper and lower bumper transitions can form a taper from the lower bell and the base, respectively, to the label mounting region. An upper label mounting area can be present between the circumferential ring and the upper bumper transition. The label mounting area can further include a lower ring, and a lower label mounting area between the lower ring and the lower bumper transition.

The vacuum panels on the container can include a recessed surface in which is contained a raised island. The upper surface of the raised island and/or the recessed surface can be designed to flex in response to a vacuum inside the container brought about during a hot-fill process. The width defined by opposing islands on the container can be about the same as the width of the label mounting surface.

Further objectives and advantages, as well as the structure and function of preferred embodiments will become apparent from a consideration of the description, drawings, and examples.

BRIEF DESCRIPTION OF THE DRAWINGS

The foregoing and other features and advantages of the invention will be apparent from the following, more particular description of a preferred embodiment of the invention, as illustrated in the accompanying drawings wherein like reference numbers generally indicate identical, functionally similar, and/or structurally similar elements.

DETAILED DESCRIPTION OF THE INVENTION

Exemplary embodiments of the invention are discussed in detail below. In describing embodiments, specific terminology is employed for the sake of clarity. However, the invention is not intended to be limited to the specific terminology so selected. While specific exemplary embodiments are discussed, it should be understood that this is done for illustration purposes only. A person skilled in the relevant art will recognize that other components and configurations can be used without parting from the spirit and scope of the invention. All references cited herein are incorporated by reference as if each had been individually incorporated.

Figure 3:
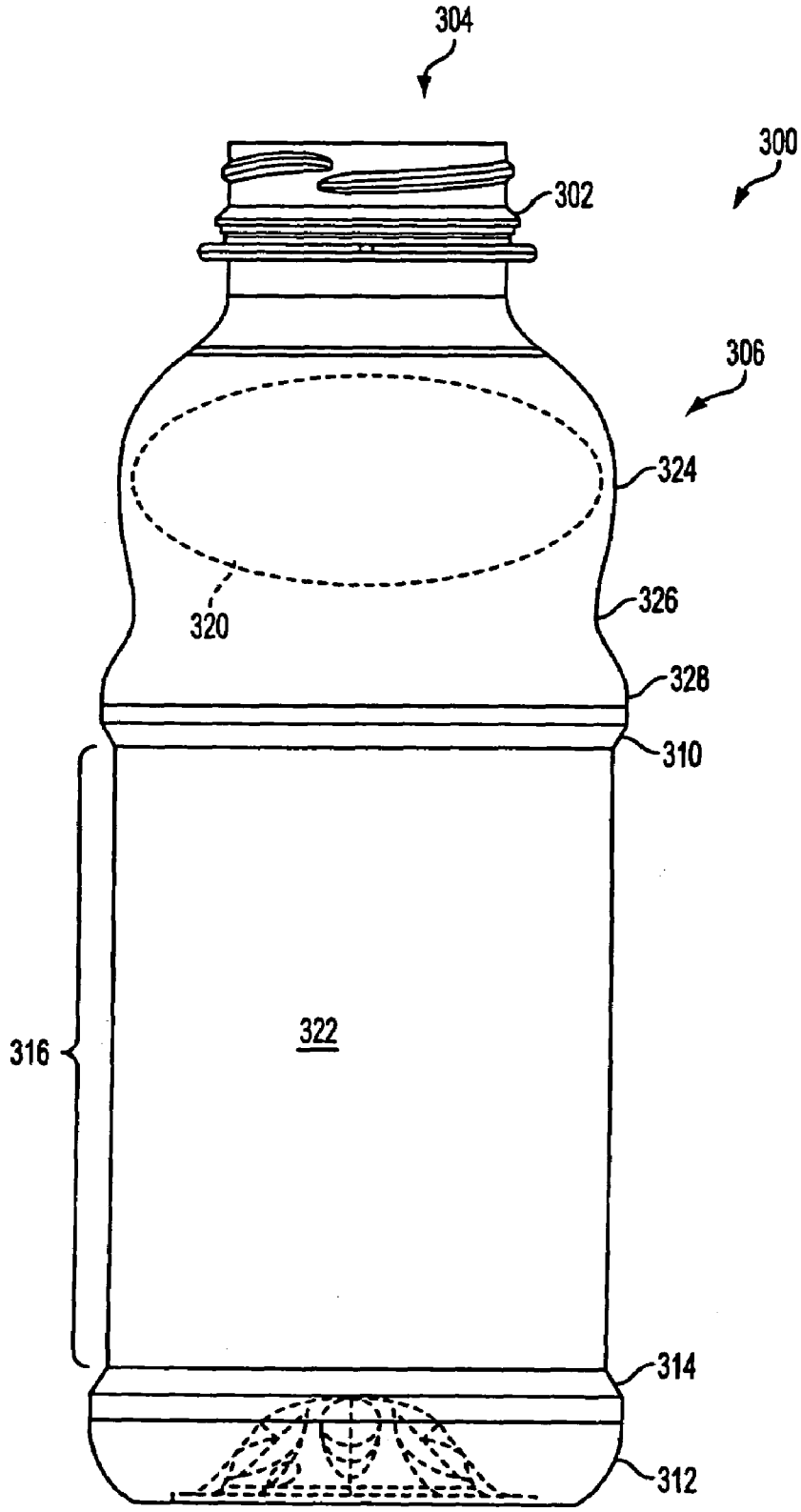
FIG. 3 depicts an exemplary embodiment according to the present invention having a label on the label mounting region.

A container according to the invention overcomes difficulties of the prior art and provides desirable design attributes by improving several aspects. An exemplary embodiment of the invention is shown in FIG. 3. The container 300 shown in FIG. 3 includes a finish 302 having an opening 304. Adjacent to the finish 302 is a tubular dome 306. The container 300 has a base 312 at an end distal to the finish 302. Appended to the container 300 is a label 322. The label 322 hides various features of the container 300, discussed further below, that are useful in preventing distortion during hot fill processing. The label 322 is present in a label mounting region 316 defined at its upper end by an upper bumper transition 310 and at its lower end by a lower bumper transition 314.

Although useful in containers of any size, a dome 306 according to the present invention, when used in a small container, provides benefits normally obtainable only in a larger container when existing methods are used. For example, the dome 306 includes a wide upper bell 324 that allows for a large logo presentation area 320 as compared to conical shaped domes of the prior art. In particular, the dome 306 includes an upper bell 324. As the dome surface is traced in a direction leading away from the finish, the full rounded surface of the upper bell 324 sweeps back with a negative radius to form a waist 326. The sweep of the dome then reverses direction again from the waist 326 to a lower bell 328 with a diameter larger than the waist 326. The lower bell 328, which joins the upper bumper transition 310, can be considered a ring or "donut" formed between the more narrow waist 326 and the label mounting region 316. The addition of the waist 326 in combination with the ring of the lower bell 328 reduces the tendency of the dome to undergo ovalization as compared to similarly sized conical domes.

Figure 4:
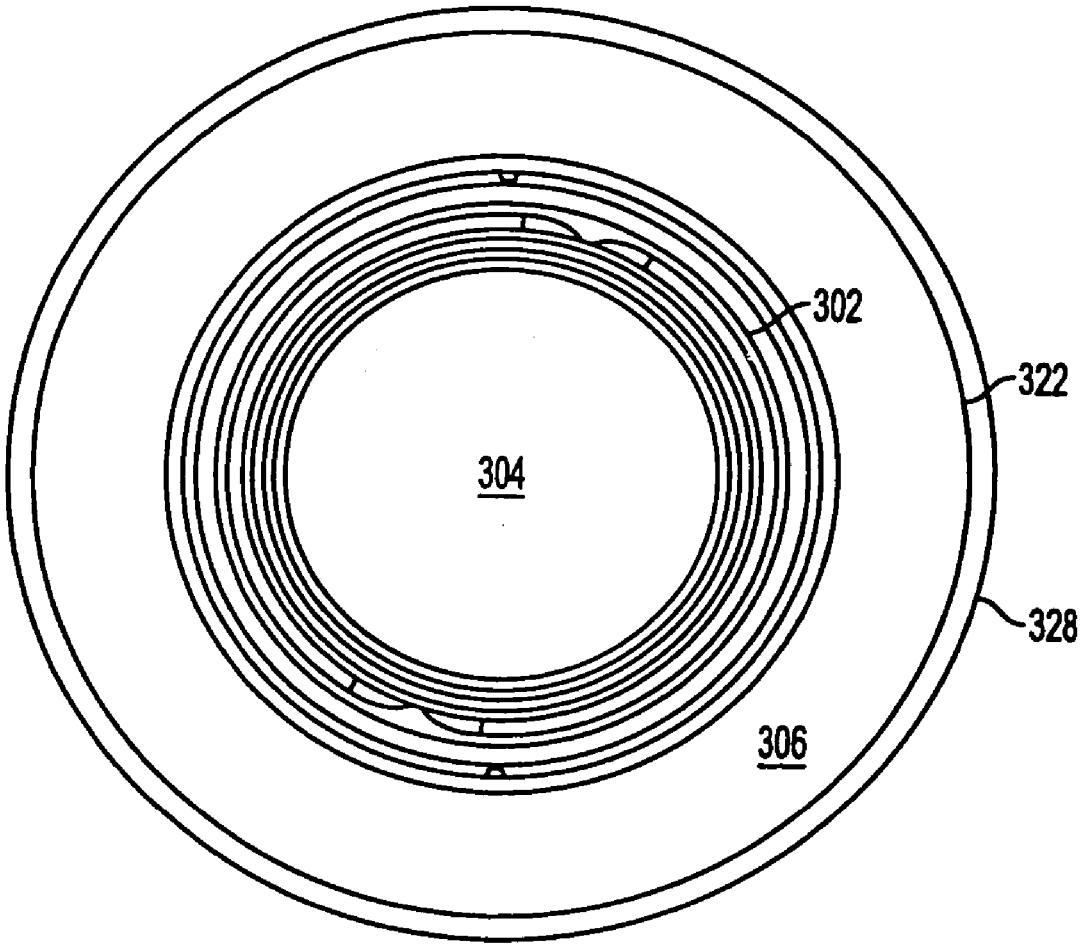
FIG. 4 depicts a top view of an exemplary embodiment according to the present invention.

As can be seen in FIG. 3, the tubular dome 306 is devoid of supporting rib structures. Thus, the cross sectional shape of the dome is maintained without interruption throughout its extent from the finish 302 to the upper bumper transition 310. The absence of ribs and the larger diameter of the upper bell 324 near the finish 302 allows for a relatively large logo presentation area 320. FIG. 4 illustrates a top view of the exemplary embodiment of the container 300. This view further shows the absence of reinforcing ribs in the dome 306. As seen in FIG. 4, the tubular dome of this exemplary embodiment is substantially circular in cross section, i.e. the dome 306 and container 300 are substantially cylindrical structures, as well as being uninterrupted. As will be appreciated, other embodiments of the present invention can have a tubular dome 306 with some other cross-sectional shape including, but not limited to, having a substantially oval, substantially triangular, substantially rectangular, substantially square or other substantially polyhedral shape.

Figure 5:
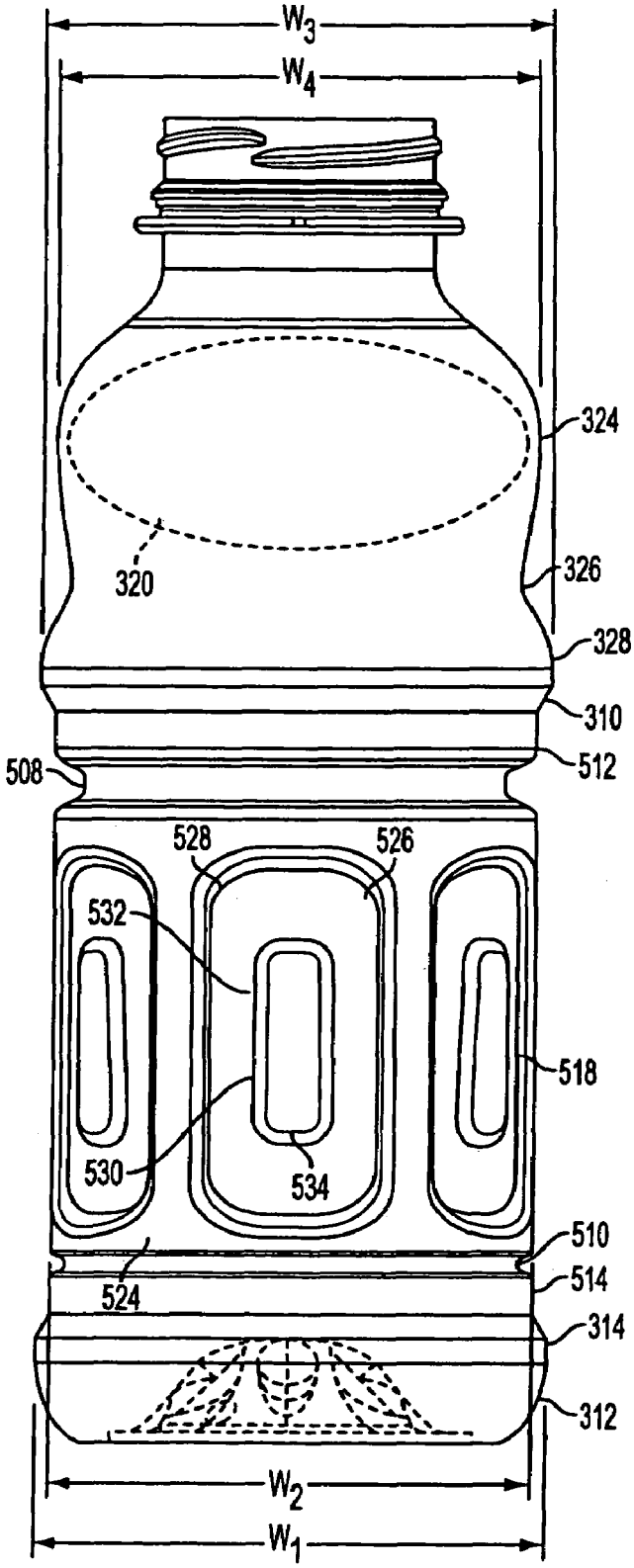
FIG. 5 depicts an exemplary embodiment of a container according to the present invention with the label removed.

FIG. 5 is an illustration of the exemplary embodiment of the container 300 with the label 322 removed. A circumferential ring 508 is located adjacent to the upper bumper transition 310. As in prior art containers, the circumferential ring 508 is a concave arcuate structure. The radius of the arc is relatively small and the arc traverses a relatively large angle, as with circumferential rings in prior art containers. Further, due to the dimensions of the arc, the circumferential ring 508 provides structural support to resist ovalization. However, unlike prior art containers, the circumferential ring 508 need not be adjacent to the dome to provide the needed support. Rather, the circumferential ring 508 of the present invention is positioned below the upper bumper transition so that it can be placed under the label 322.

Under the label 322, the label mounting region 316 includes a label mounting surface 524 and vacuum panels 518. An upper label mounting area 512 can be present between the circumferential ring 508 and the upper bumper transition 310. Optionally, a lower ring 510 can be present under the label 322. A lower label mounting area 514 can be located between the lower ring 510 and lower bumper transition 314. The label mounting surface 524 forms a tubular sidewall to which the label 322 may be adhered by, for example, gluing. In the illustrated embodiment, the tubular sidewall formed by the label mounting surface 524 is substantially cylindrical in cross section. However, as with the dome 306, the sidewall can have other cross-sectional shapes. The relatively flat label mounting surface 524 is interrupted by the vacuum flex panels 518. The vacuum flex panels 518 are comprised of a recess surface 526 joined to the label mounting surface 524 by a recess wall 528. Located within the recess surface 526 is a raised island 530 connected to the recess surface 526 by a connecting wall 532. The raised island 530 includes an upper surface 534 that is relatively flat, with a number of such islands defining a surface of the same shape as the label mounting surface 524. The connecting wall 532 surrounding each island 530 forms a periphery of the upper surface 534 of the island.

Although containers according to the invention may be of any size, an exemplary embodiment provides a container 300 suitable for containing small volumes of liquid, for example, 20 ounces or less, 12 ounces or less and eight ounces or less, while maintaining advantages generally found in larger containers. For example, the container of FIG. 3 provides a relatively large logo presentation area 320, for embossing a logo, by eliminating ribs in the dome. Moreover, the container of FIG. 3 presents an aesthetically pleasing appearance by hiding structural elements of the container under the label 322. In particular, the circumferential ring 508 is moved to a position more distal to the dome 306 such that, for example, the circumferential ring 508 and the dome 306 are on opposite sides of the upper bumper transition 310, allowing the circumferential ring 508 to be positioned under the label 332.

Referring again to FIG. 5, the illustrated embodiment has a width that varies depending upon the region of the bottle. The base 312 has a width $w_1$, that is substantially the same as the width $w_3$ of the outermost portion of the lower bell 328. The label mounting surface 524 has a width $w_2$ that is less than the width $w_1$ of the base and width $w_3$ of the lower bell 328. Finally, the upper bell 324 has an outermost width $w_4$ that is less that the width $w_3$ of the lower bell 328.

As a result of the dimensional changes of the exemplary embodiment of FIG. 5, particularly the relationship of $w_1$ and $w_3$ to $w_2$, the upper bumper transition 310 is tapered to provide a narrowing in going from the lower bell 328 to the label mounting region. Similarly, the lower bumper transition 314 is tapered to provide a narrowing in going from the base 312 to the label mounting region. The taper of the upper and lower bumper transitions 310, 314 may be linear, as shown in the illustrated embodiment, or arcuate. The increased ratio of base and lower bell widths $w_1$ and $w_3$, respectively, to the width $w_2$ of the label mounting surface 524, along with the angling of the upper bumper transition 310 and the lower bumper transition 314 increases the strength of the container, i.e. reduces ovalization, as compared to prior art containers. The ring shaped geometry of the lower bell 328, due to its placement between the waist 326 and the upper bumper transition 310, also provides an added structural support for the upper bumper transition 310. Finally, the combination of the expanded lower bell 328, reduced label mounting region width $w_2$ and waist 326 cooperate to provide sufficient rigidity to provide adequate top load support and resist ovalization.

The presence of a circumferential ring 508 under the label panel according to the present invention allows the use of a waist 326 in the dome which is structurally distinct from circumferential rings of prior art domes. Prior art circumferential rings that have an angular extent $\Theta$ of from about 45° to about 90°. See FIG. 6 and U.S. Pat. No. 5,303,834, for example. Furthermore, a circumferential ring as used in the prior art would generally have a very small radius of curvature $r_1$, for example, varying from about 0.3 to about 0.7 times the depth of the ring, $d_1$ or $d_2$. The internal radius $r_2$ of prior art containers bends from the ring back to the main body of the container is generally about 0.3 times the depth of the ring, $d_1$ or $d_2$.

In the present invention, the angular extent $\Theta$ of the waist can be greater than 90°, for example, between 120° to 150°. The waist depth $d_1$, $d_2$ can be significantly less than the radius of curvature $r_1$ within the waist. The ratio of the radius of curvature to the waist depth ($r_1$:$d_1$ or $r_1$:$d_2$) with respect to the upper bell or with respect to the waist depth at the lower bell can be 1 or more. For example, the ratio of the radius of curvature to the waist depth in the upper bell ($r_1$:$d_1$) can be from about 2 to about 4 and the ratio of the radius of curvature to the waist depth at the lower bell ($r_1$:$d_2$) can be from about 3 to about 6. Furthermore, in prior art containers having a circumferential ring, the ring depth is generally about 0.10 to 0.24 times the radius of the container $R_1$, $R_2$ measured from the container central axis A. According to the present invention, the ratio of the waist depth $d_1$, $d_2$ to the container radius $R_1$, $R_2$ can be less than 0.1. For example, the ratio of the waist depth of the present container relative to the radius at the outermost extent of the upper bell can be less than 0.1 for example, for about 0.07. The same applies to the ratio of the waist depth with respect to the radius of the lower bell.

Figure 7:
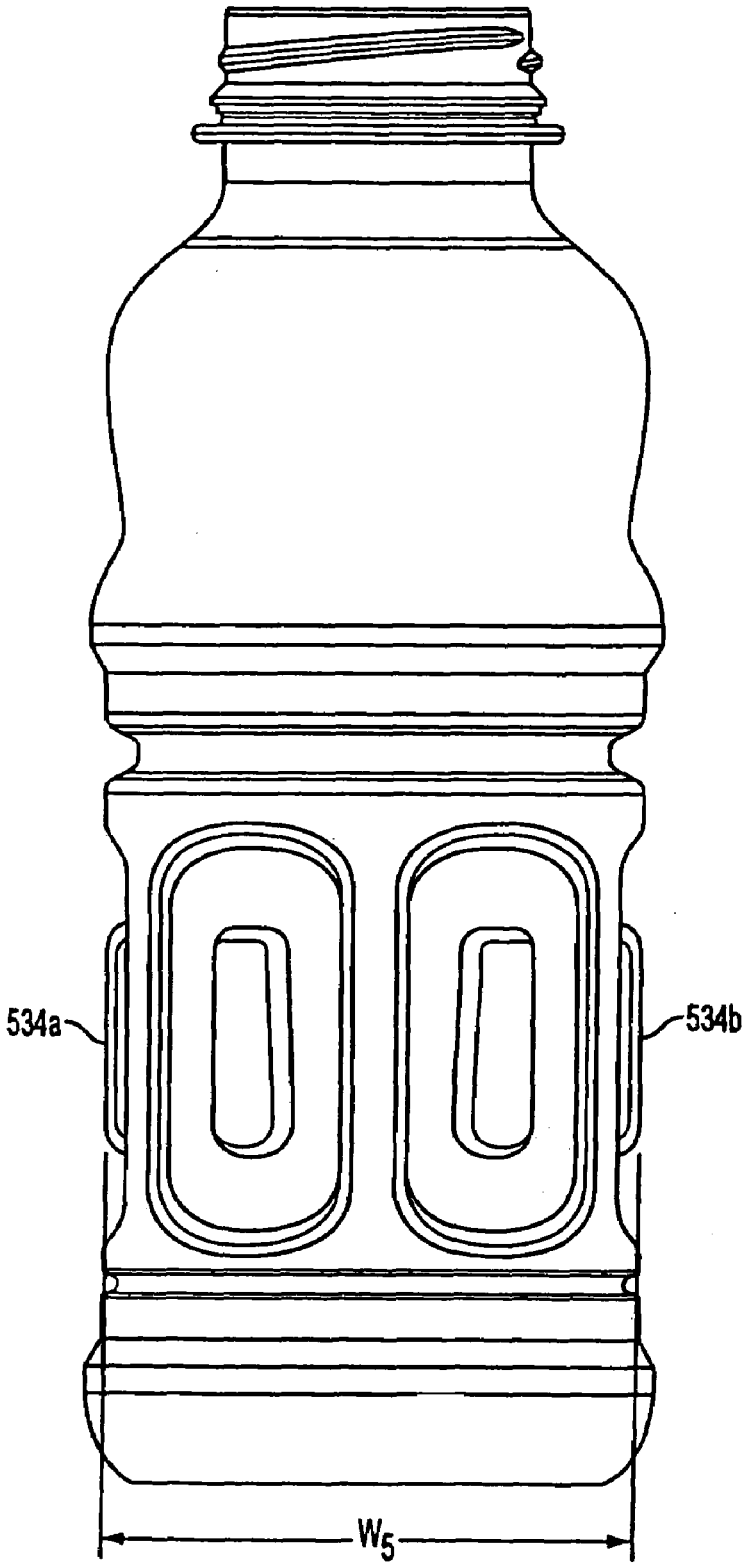
FIG. 7 depicts the exemplary embodiment of FIG. 5 rotated by about 30°.

FIG. 7 is a side view of the container 300 rotated approximately 30° relative to the view of FIG. 5. Upper surfaces 534*a*, 534*b* of islands in the label mounting region that are disposed 180° to one another, i.e. opposite one another, define a width $w_5$. The width $w_5$ of the upper island surfaces can be the same as the width $w_2$ of the label mounting surface 524. It will be understood by persons skilled in the art that, where there are an odd number of vacuum panels such that no two are opposite one another, the upper surfaces of the islands taken as a whole can define a diameter that is analogous to the width $w_5$. Because $w_5$ and $w_2$ are approximately equal, the label 322 can be adhered to both the label mounting surface 524 and the upper surfaces 534 of the islands. This configuration allows for increased support of the label relative to most prior art bottles wherein the analogous width $w_5$ defined by the upper surface of the vacuum panel is less than the width $w_2$ of the label mounting surface 524. This increased label support is beneficial because positioning the circumferential ring 508 under the label reduces the total surface area of the label mounting surface 524.

Figure 1:
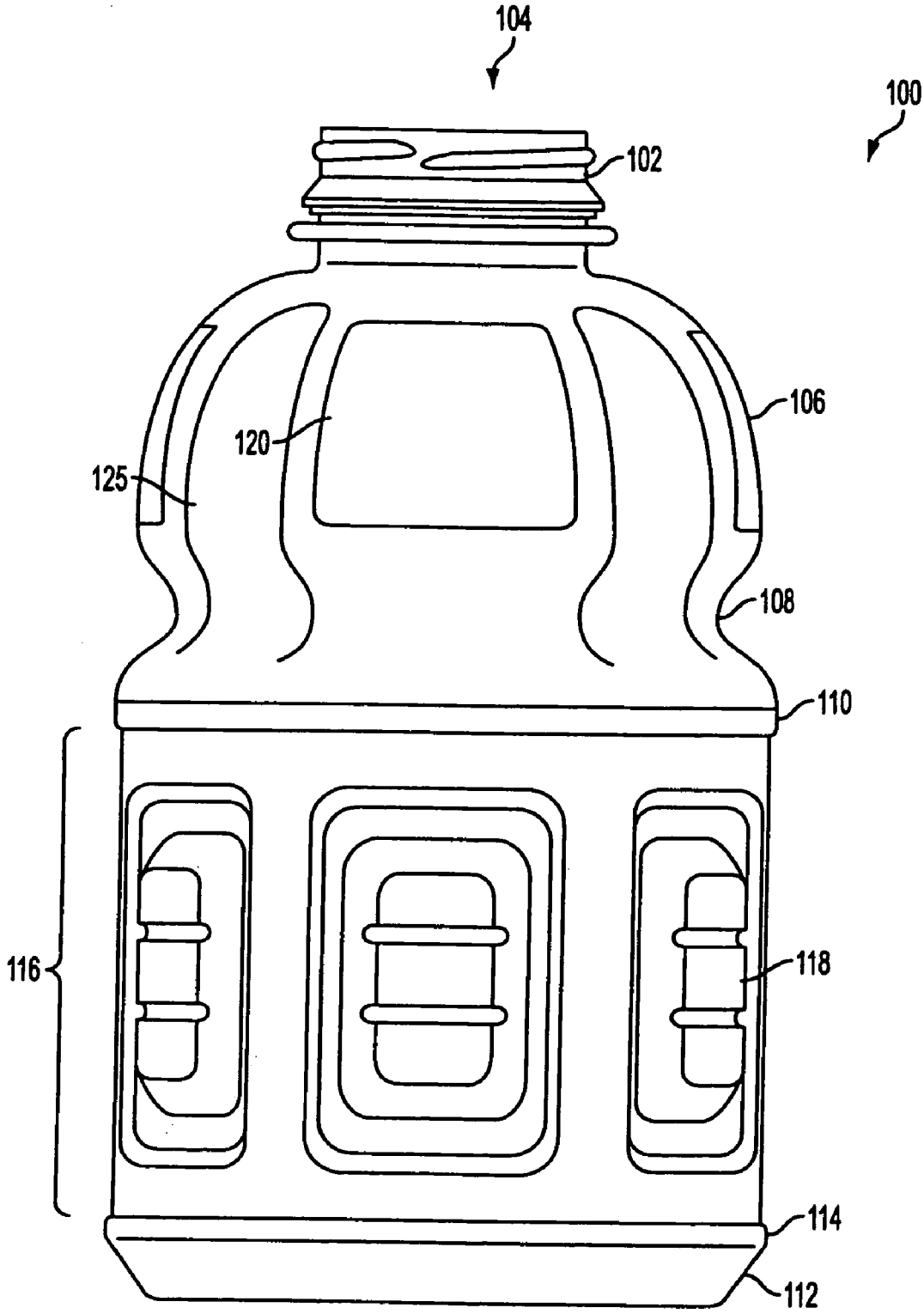
FIG. 1 PRIOR ART
FIG. 1 depicts a prior art container having a circumferential ring adjacent to the dome and reinforcing ribs in the dome.
Figure 2:
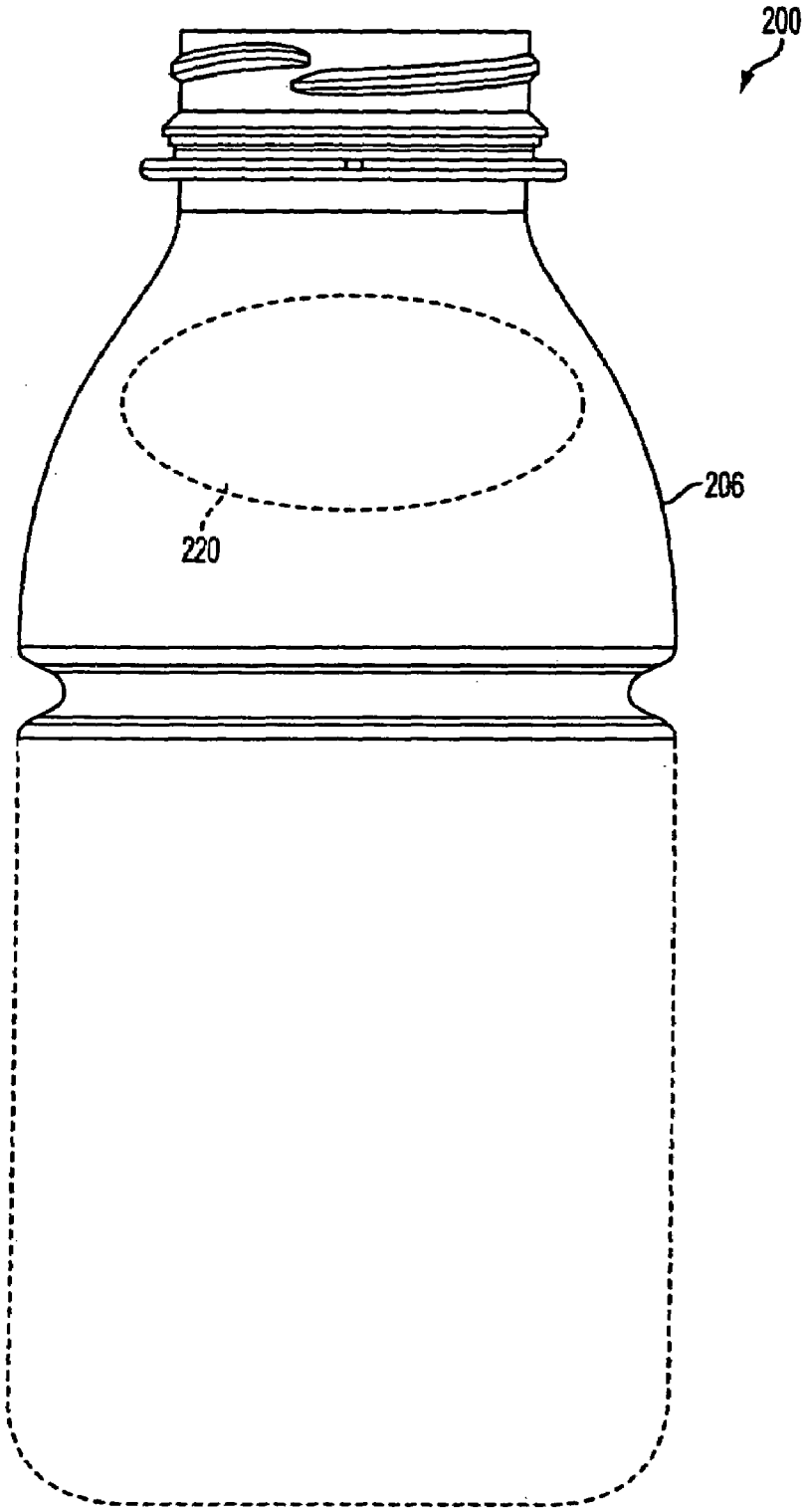
FIG. 2 PRIOR ART
FIG. 2 depicts a prior art container having a conical dome.

Other design features can be considered in containers according to the present invention. For example, whereas containers according to the prior art would only be required to have vacuum flex panels under the label (see 118, FIG. 1), containers according to the present invention require the presence of both vacuum panels 518 and a circumferential ring 508 under the label 322. If, as is often the case, it is desirable not to change label size when creating a container in accordance with the invention, the size of the vacuum panels must be reduced to make space for the circumferential ring 508. Additionally, because of the rigidity of the dome 306 that results from the combination of the waist 326, lower bell 328 and circumferential ring 508, vacuum panels 518 can become the primary feature that provides vacuum relief and structural integrity for the container.

As a result of the above factors, it can be desirable to utilize vacuum panels that more efficiently accommodate the vacuum forces created during the hot-fill process. It is thus useful to utilize a vacuum panel structure wherein a surface of the vacuum panel flexes to accommodate such forces. In particular embodiments, a surface adjacent the upper surface 534 of the island, for example the recess surface 526, can flex in response to vacuum forces. One useful way of achieving this is to form the vacuum panels such that the recess surface 526 has a pressure responsive panel structure as disclosed in U.S. patent application Ser. No. 09/689,957 to Melrose, which is incorporated herein by reference in its entirety, with the island 530 incorporated into a central portion of the recess surface 526. The more effectively vacuum forces are accommodated by the vacuum panels 518, the more variability can be built into the design of the container dome 306.

For example, in the illustrated embodiment, the relatively shorter vacuum panels 518, the structural geometry of the upper bumper transition 310 and the waist 326 cooperate to provide top load strength and resistance to ovalization. This allows the surface of the upper bell 324 that is not interrupted by ribs or other structural features to be proportionately larger than the label mounting region 316; i.e. the invention provides for an increased uninterrupted surface area in the dome relative to the surface area of the label as compared to the prior art. This increased uninterrupted surface area allows for the incorporation of design features, for example a product logo or other identifying feature, in the dome rather than on the label. Thus, designs can be directly embossed into the container in three dimensions, rather than being present only on the label in two dimensions.

Another design consideration for containers according to the present invention is optimizing the curvature of the waist 326 and lower bell 328 to achieve optimized performance characteristics, for example, top load strength and resistance to ovalization. There is a wide range of variability in design according to the invention, limited only by the desired predetermined performance characteristics as defined by the particular use or application. However, performance of containers in accordance with the present invention can often be optimized using iterative techniques well known to persons skilled in the art of hot-fill container design. Features which can be varied to achieve optimal performance of containers according to the invention include, but are not limited to, curvature of the upper bell 324, the lower bell 328, and the waist 326; relative widths of the upper bell 324, lower bell 328, and waist 326; distance between the circumferential ring 508 and the lower bell 328; and relative widths of the base $w_1$, label mounting region $w_2$ and lower bell $w_3$, as well as the width of the upper waist $w_3$ and upper bell $w_4$. Adjusting these relative parameters can lead to designs in which the various features cooperate to provide a predetermined top load strength and resistance to ovalization. For example, in the embodiment illustrated in FIG. 3, the upper bumper transition 310, the waist 326 and the circumferential ring 508 individually and collectively contribute to the structural stability of the design.

In addition, where the widths of the base $w_1$, label mounting region $w_2$ and lower bell $w_3$ are different, the upper bumper transition 310 and lower bumper transition 314 must taper from the lower bell 328 to the label mounting region 316 and from the label mounting region 316 to the base 312, respectively. The height of the upper and/or lower bumper transitions 310, 314 can be adjusted to provide different angles of the taper. In addition, the linearity of the taper can be changed, for example from linear to arcuate. Varying the shape of the upper and/or lower bumper transitions 310, 314 can provide a predetermined top load strength and resistance to ovalization.

Figure 9:
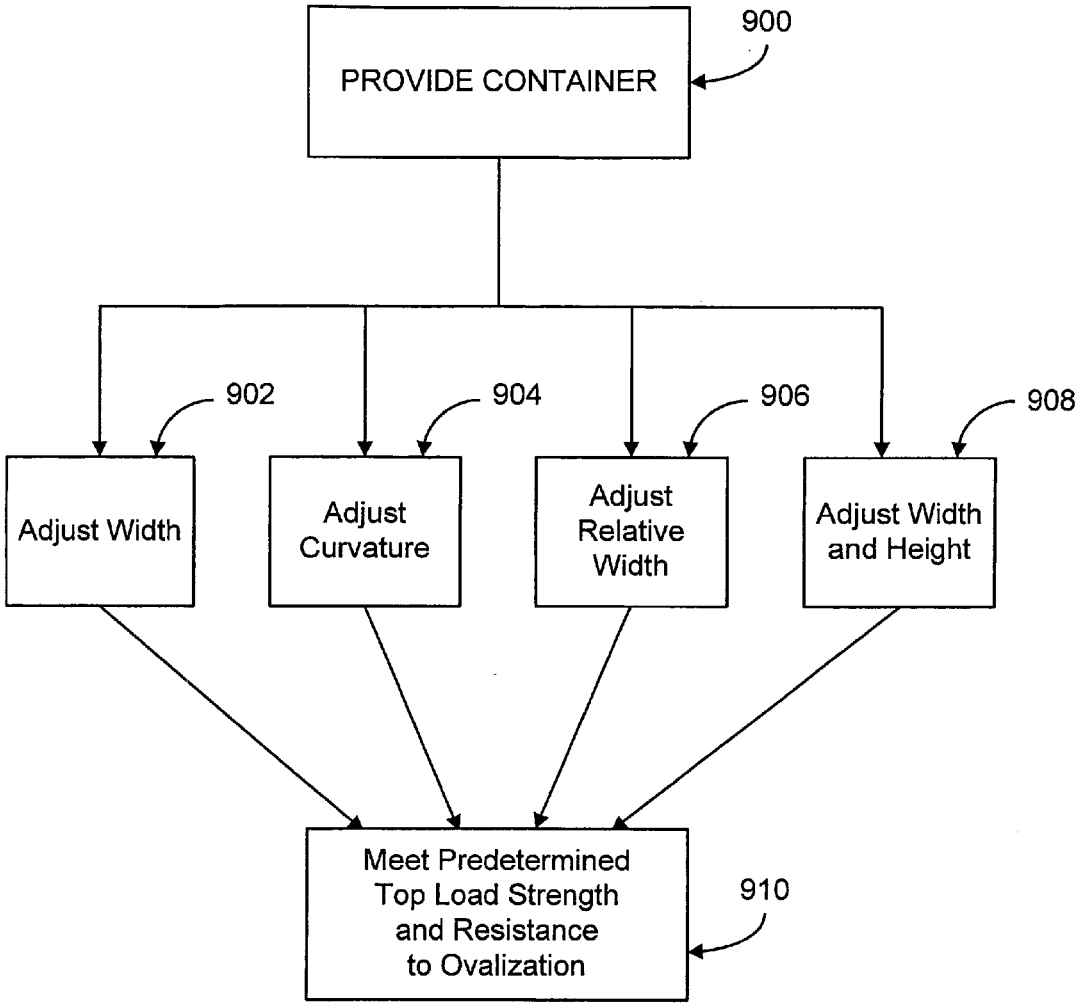
FIG. 9 depicts a method according to an exemplary embodiment of the invention.

FIG. 9 depicts a method for forming a container with a predetermined top load strength and resistance to ovalization according to an exemplary embodiment of the invention. As shown in FIG. 9, the first step 900 of the method comprises providing a container having attributes according to the present invention. For example, the container includes a finish with an opening, a base distal to the finish, a lower bumper transition adjacent to the base, and an upper bumper transitioned; wherein the upper bumper transition and lower bumper transition define a label mounting region that includes a circumferential ring adjacent to the upper bumper transition and a vacuum panel region. The container also includes a tubular dome between the upper bumper transition and the finish. The tubular dome has a cross sectional shape that is substantially the same throughout. The tubular dome includes an upper bell a peripheral waist having a angular extent of greater than about 90° and a lower bell.

According to one exemplary embodiment, the second step 902 of the method includes adjusting a width of one or more of the upper bell, the waist, the lower bell or the label mounting region. After adjustment, the container meets the predetermined top load strength and ovalization resistance as 910. In addition to adjusting the width of the upper bell, waist, lower bell or label mounting region, the method can also include a step 904 of adjusting the curvature of the upper bell of the waist and/or the lower bell. Additionally, the method can include a step 906 of selecting a width of the upper dome relative to the width of the label mounting region. Finally, the method can include a step 908 of selecting a width of the upper dome and the height of the label mounting region that increases the proportional surface area of the dome relative to the surface area of the label mounting region. The steps 902–908 of the method altering one or more of the container features outlined above results in obtaining a container having 910 a predetermined top load strength and resistance to ovalization.

EXAMPLE 1

Figure 8:
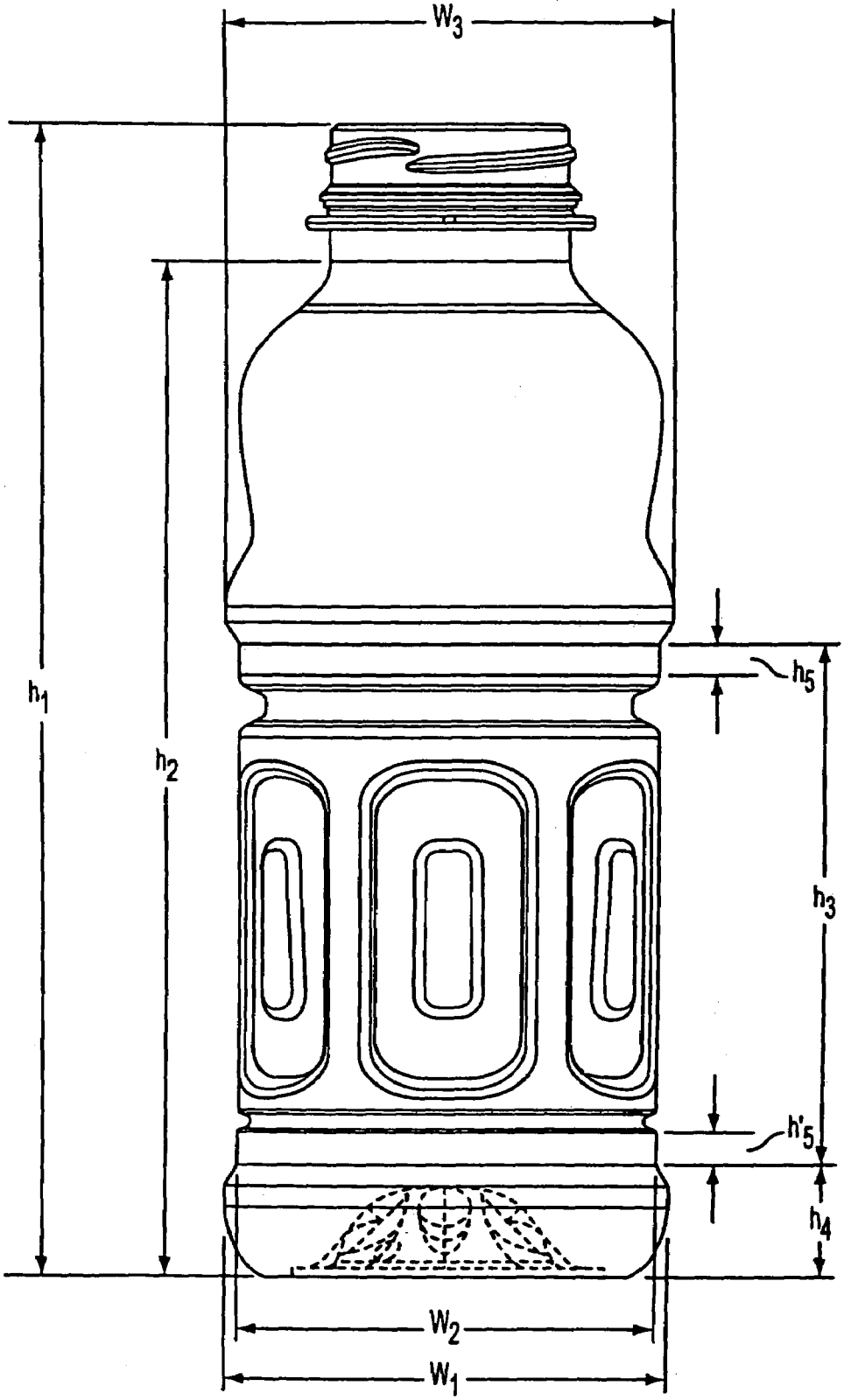
FIG. 8 depicts an embodiment of the invention showing FIG. 7 showing exemplary dimensions.

FIG. 8 illustrates an exemplary embodiment of the invention having particular dimensions and designed to contain about 20 oz (591 mL) of liquid. Accordingly to this exemplary embodiment, the diameter of the base, $w_1$, and the upper bell, $w_3$, are each about 2.9 in (74 mm). The label mounting region has a diameter $w_2$, that is slightly smaller and is about 2.8 in (70 mm). The overall height of the container $h_1$ is 8.0 in (205 mm) with the height, $h_2$, to the bottom of finish of 7.1 in (180 mm). The height, $h_4$, from the base to the lowest point of the label mounting region is 0.8 in (20 mm). The overall height, $h_3$, of the label mounting region between the upper and lower bumper transitions 310, 314 is 3.7 in (93 mm). The heights of the upper label mounting area and lower label mounting area, $h_5$, $h_5'$ are each 0.2 in (6 mm).

Figure 6:
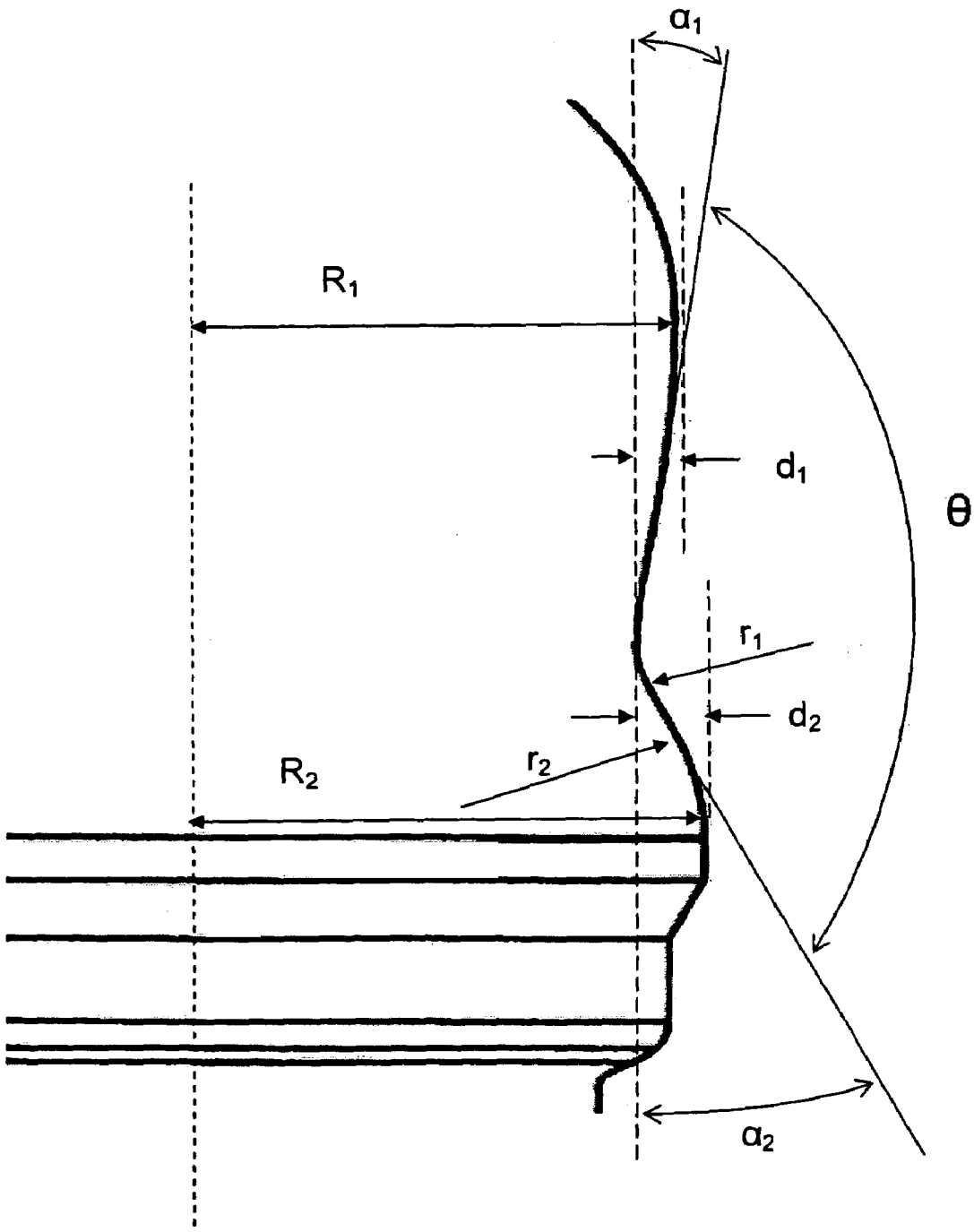
FIG. 6 is a detail of the upper bell according to an embodiment of the invention.

Parameters describing the dimensions of the waist in this exemplary embodiment of the invention are identified in FIG. 6. The radial distance from the central axis of the container to the outermost extent of the upper bell ($R_1$) is about 1.38 inches. The radial distance from the axis to the outermost portion of the lower bell ($R_2$) is about 1.46 inches. The radius of curvature ($r_1$) of the waist is about 0.37 inches and the connecting radius from the waist to the outermost portion of the lower bell ($r_2$) is about 0.59 inches. The upper wall of the waist which extends from the deepest part of the waist to the outer wall of the upper bell forms an angle ($\alpha_1$) of about 10°. Because the lower portion of the bell is wider than the upper bell and the distance from the most narrow portion of the waist 326 to the outermost portion of the lower bell 328 is smaller than the distance from the most narrow portion of the waist 326 to the outermost portion of the upper bell 324, the angle extending from the depth of the waist to the outer wall of the lower bell ($\alpha_2$) is about 35°. With these considerations, the angular extent $\Theta$ swept out by the waist is approximately 135°. The depth of the waist with respect to the upper bell ($d_1$) is about 0.09 inches and the depth of the waist with respect to the outermost portion of the lower bell ($d_2$) is approximately 0.17 inches. Thus, the ratio of the radius of the waist $r_1$ to the waist depth $d_1$, $d_2$ is approximately 2.1 to 3.3 and the ratio of the connecting radius to the outermost portion of the container $R_1$, $R_2$) is approximately 3.4 to 6.2. These numbers vary depending on whether the waist depth is measured with respect to the upper bell or the lower bell. In prior art containers, the distances $d_1$ and $d_2$ are approximately equal and are generally larger than the radius of curvature $r_1$. Thus, in prior art containers the ratio of radius of curvature $r_1$ to the depth $d_1$ of a circumferential ring is much smaller, for example, in the range of 0.3 to 0.7.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

What is claimed is:

1. A hot-fillable blow molded plastic container comprising:

a finish with an opening;

a base distal to said finish;

a lower bumper transition adjacent to said base;

an upper bumper transition that, together with said lower bumper transition, defines a label mounting region that comprises a vacuum panel region;

a tubular dome between said upper bumper transition and said finish having cross sectional shape that is substantially the same throughout and comprising an upper bell;

a peripheral waist having an angular extent of greater than about 90°; and a lower bell; and a circumferential ring below said upper bumper transition.

2. The container according to claim 1, wherein said label mounting region comprises said circumferential ring and said circumferential ring is adjacent said upper bumper transition.

3. The container of claim 2, said label mounting region further comprising a lower ring and an upper label mounting area between said circumferential ring and said upper bumper transition and a lower label mounting area between said lower ring and said lower bumper transition.

4. The container according to claim 3, further comprising a label disposed between said upper bumper transition and said lower bumper transition and covering said circumferential ring and said vacuum panel region.

5. The container according to claim 1, said upper bell comprising a logo.

6. The container according to claim 1, said vacuum panel region comprising vacuum panels, said vacuum panels having a raised island therein.

7. The container according to claim 6, said raised island having adjacent surfaces that flex in response to a vacuum inside the container during a hot-fill process.

8. The container according to claim 6, further comprising a label mounting surface, wherein a width of said label mounting surface is approximately equal to width defined by opposing raised islands on the container.

9. The container according to claim 8, further comprising a label disposed between said upper bumper transition and said lower bumper transition and covering said circumferential ring, and said vacuum panels.

10. The container according to claim 8, wherein said label is adhered to said label mounting surface and said island.

11. The container according to claim 1, said label mounting region having a width that is less than a width of said base.

12. The container according to claim 1, said base having a width that is approximately equal to a width of an outer periphery of said lower bell.

13. The container according to claim 1, said base having a width that is approximately equal to a width of an outer periphery of said lower bell and said label mounting region having a width that is less than a width of said base.

14. The container of claim 13, wherein said upper bumper transition provides a first taper between said lower bell and said label mounting region and said lower bumper transition provides a second taper between said base and said label mounting region.

15. The container of claim 14, wherein said first taper and said second taper are linear.

16. The container according to claim 1, wherein the tubular dome has a cross sectional shape selected from substantially circular, substantially oval, substantially triangular, substantially rectangular, substantially square and substantially polyhedral.

17. The container according to claim 1, wherein the tubular dome has a substantially circular cross sectional shape.

18. The container according to claim 1, said container having an internal volume of about 20 fluid ounces or less.

19. The container according to claim 1, wherein said waist, said upper bumper transition and said circumferential ring cooperate to provide top load strength and resistance to ovalization.

20. The container according to claim 1, wherein said waist, said lower bell and said circumferential ring cooperate to provide top load strength and resistance to ovalization.

21. The container according to claim 1, wherein the curvature of the waist and the curvature of the lower bell are selected to provide top load strength and resistance to ovalization.

22. The container according to claim 1, said dome having a proportionately large uninterrupted surface area relative to a surface area of said label mounting region.

23. A hot-fillable blow molded plastic container comprising:

a finish with an opening;

a base distal to said finish;

a lower bumper transition adjacent to said base;

an upper bumper transition that, together with said lower bumper transition defines a label mounting region having a width that is less than a width of said base and comprising a circumferential ring adjacent to and below the upper bumper transition; and a vacuum panel region below said circumferential ring; and a substantially cylindrical dome between said upper bumper transition and said finish and having a cross sectional shape that is substantially the same throughout and comprising an upper bell;

a peripheral waist having an angular extent of greater than about 90°; and a lower bell having a width that is larger than the width of said label mounting region and approximately equal to the with of said base;

wherein said upper bumper transition is linearly tapered between said lower bell and said label mounting region and said lower bumper transition is linearly tapered between said label mounting region and said base; and said upper bumper transition and said circumferential ring cooperate to provide top load strength and resistance to ovalization.

24. A method for making a container having a predetermined top load strength and resistance to ovalization comprising, providing a container having a finish with an opening;

a base distal to said finish;

a lower bumper transition adjacent to said base;

an upper bumper transition that, together with said lower bumper transition defines a label mounting region that comprises a circumferential ring adjacent to the upper bumper transition and a vacuum panel region;

a tubular dome between said upper bumper transition and said finish having cross sectional shape that is substantially the same throughout and comprising an upper bell;

a peripheral waist having an angular extent of greater than about 90°; and a lower bell; and adjusting a width of at least one of said upper bell, said waist, said lower bell and said label mounting region;

thereby providing a container having a predetermined top load strength and resistance to ovalization.

25. The method according to claim 24, further comprising adjusting a curvature of at least one of said upper bell, said waist, and said lower bell.

26. The method according to claim 24, further comprising selecting a width of said lower dome relative to a width of said label mounting region.

27. The method of claim 24, further comprising selecting a width of said upper dome and a height of said label mounting region that increases the proportional surface area of said dome relative to a surface area of said label mounting region.

* * * * *